US007596235B2

(12) United States Patent
Michiels

(10) Patent No.: US 7,596,235 B2
(45) Date of Patent: Sep. 29, 2009

(54) TRANSDUCER

(75) Inventor: Hugo Michiels, Moerbeke-Waas (BE)

(73) Assignee: Sonitron, Naamloze Vennootschap, Sint-Niklaas (BE)

( * ) Notice: Subject to any disclaimer, the term of this patent is extended or adjusted under 35 U.S.C. 154(b) by 0 days.

(21) Appl. No.: 10/685,576

(22) Filed: Oct. 16, 2003

(65) Prior Publication Data

US 2004/0081326 A1 Apr. 29, 2004

(30) Foreign Application Priority Data

Oct. 21, 2002 (BE) ..... 2002/0601

(51) Int. Cl.
*H04R 25/00* (2006.01)

(52) U.S. Cl. ..... 381/152; 381/190; 381/431

(58) Field of Classification Search ..... 434/116, 434/308, 319; 310/330, 334, 358; 381/152, 381/190, 173, 423–426, 431
See application file for complete search history.

(56) References Cited

U.S. PATENT DOCUMENTS

| | | | | | |
|---|---|---|---|---|---|
| 4,439,640 | A * | 3/1984 | Takaya | 381/190 |
| 4,473,769 | A * | 9/1984 | Nguyen | 310/334 |
| 4,552,243 | A * | 11/1985 | Melillo et al. | 181/169 |
| 5,043,622 | A * | 8/1991 | Sagong et al. | 310/358 |
| 5,663,894 | A * | 9/1997 | Seth et al. | 73/654 |
| 5,744,898 | A * | 4/1998 | Smith et al. | 310/334 |
| 5,838,805 | A * | 11/1998 | Warnaka et al. | 381/190 |
| 5,852,589 | A * | 12/1998 | Wilson et al. | 367/157 |
| 6,088,894 | A * | 7/2000 | Oakley et al. | 29/25.35 |
| 6,169,809 | B1 * | 1/2001 | Azima et al. | 381/152 |
| 6,191,414 | B1 * | 2/2001 | Ogle et al. | 250/227.14 |
| 6,332,029 | B1 * | 12/2001 | Azima et al. | 381/152 |
| 6,548,939 | B2 * | 4/2003 | Riedel | 310/330 |
| 6,645,150 | B2 * | 11/2003 | Angelsen et al. | 600/459 |
| 6,722,003 | B2 * | 4/2004 | Dunn et al. | 29/25.35 |
| 6,985,596 | B2 * | 1/2006 | Bank et al. | 381/152 |
| 2002/0041694 | A1 | 4/2002 | Michiels | |
| 2002/0196952 | A1 * | 12/2002 | Liao | 381/190 |

FOREIGN PATENT DOCUMENTS

| | | | |
|---|---|---|---|
| BE | 1011085 | A4 | 4/1999 |
| BE | 1011559 | * | 10/1999 |
| BE | 1011559 | A4 | 10/1999 |
| GB | 1 605 040 | | 12/1981 |

* cited by examiner

*Primary Examiner*—Suhan Ni
(74) *Attorney, Agent, or Firm*—Bacon & Thomas, PLLC

(57) ABSTRACT

Improved transducer for reproducing and/or recording sound, comprising a membrane onto which is provided a one-piece or multipart piezo-electric element, characterized in that the membrane is composed of two or several layers of which at least one layer is made of polymer, and the shape of the perimeter of the piezo-electric element differs from the shape of the perimeter of the membrane.

13 Claims, 6 Drawing Sheets

TRANSDUCER

BACKGROUND OF THE INVENTION

1. Field of the Invention

The present invention concerns an improved transducer or, in other words, an element for reproducing and/or recording sound, in particular a loudspeaker or microphone.

For clarity's sake, the following description will only deal with transducers for reproducing sound, in other words sound reproducers.

In particular, the invention concerns piezo-electric reproducers of the type which make use of a vibration membrane onto which is fixed a piezo-ceramic disc.

This membrane is usually fixed to a holder in the shape of a frame or the like, along its perimeter, whereby it is glued to this holder along its perimeter with a hard or flexible glue.

2. Discussion of the Related Art

It is known that by applying an alternating voltage to the piezo-ceramic disc, the material of the piezo-ceramic disc will start to expand or shrink, and, as the membrane itself cannot expand or shrink, the whole will bend as a function of the voltage variations, as a result of which a sound signal will be generated which is proportional to the frequency and the amplitude of the applied signal.

In Belgian patents 1,011,085 and 1,011,559 of the applicant are described improvements to the aforesaid type of transducers whereby use is made of a metal membrane and whereby, in the case of patent BE 1,011,559, an elastic muffling layer made of silicones is provided on this metal membrane, comprising metal particles such as lead or the like.

A disadvantage of such a transducer with a muffling layer with metal particles is that these metal particles are very hard to recover from the muffling layer, so that these particles cannot be recycled and, as a consequence, when the transducer is discarded, it will end up on the waste heap and thus form a burdening for the environment.

In Belgian patent number 1,013,592 of the applicant, additional improvements to the aforesaid type of transducers are described whereby, in this case, a membrane is applied made of a material muffling sound vibrations, in particular a soft material such a plastic or the like.

Although the reproducers, as described in the aforesaid patents, offer very good results, the invention aims an improved transducer with unequalled results in the field of sound quality, which moreover is less harmful to the environment when being discarded.

SUMMARY OF THE INVENTION

To this end, the invention concerns an improved transducer which mainly consists of a membrane onto which is provided a one-piece or multipart piezo-electric element, wherein the membrane is composed of two or several layers of which at least one layer is made of polymer, elastomer, foamed or filled with synthetic fibers, isotropically mixed or woven fibers made of polymer or elastomer.

The membrane preferably consists of a combination of one or several layers made of polymer and one or several layers of metal foil, such as aluminum or brass foil.

Thanks to this combination of different layers, the thickness and rigidity of the membrane, depending on the application, can be adjusted in order to obtain a very accurate reproduction of the applied signal coming from a signal generator such as an amplifier, a video recorder, a mobile phone or the like.

BRIEF DESCRIPTION OF THE DRAWINGS

In order to better explain the characteristics of the invention, the following preferred embodiments of an improved transducer according to the invention are described as an example only without being limitative in any way, with reference to the accompanying drawings, in which.

DESCRIPTION OF THE PREFERRED EMBODIMENT

Figure 1:
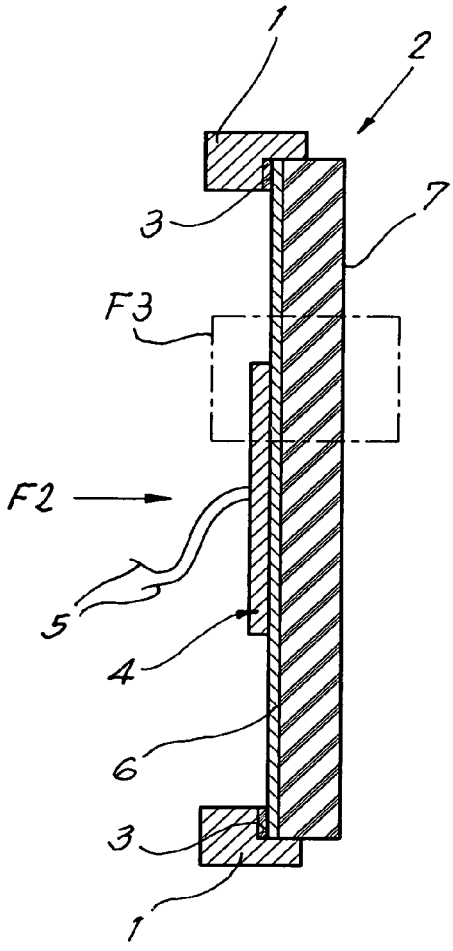
FIG. 1 schematically represents an improved transducer according to the invention.
Figure 2:
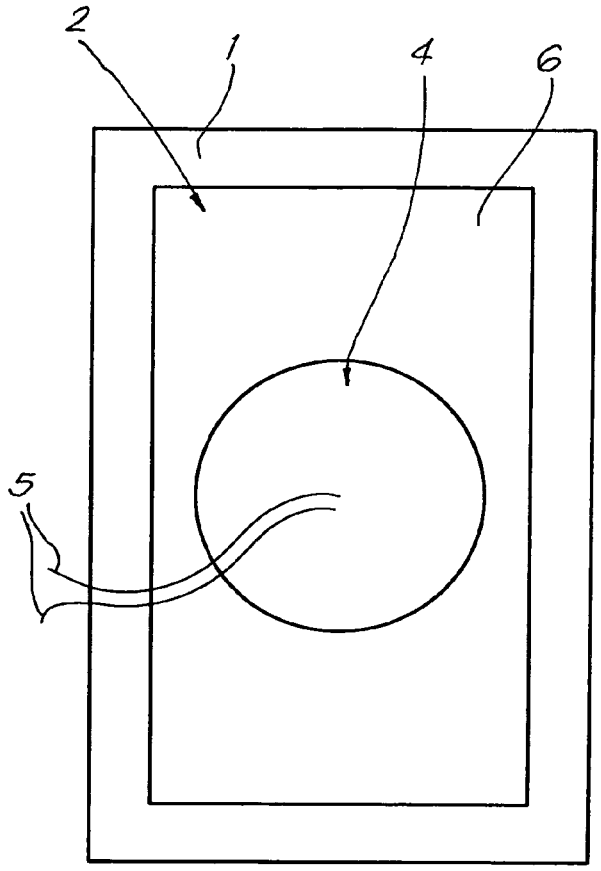
FIG. 2 represents an elevation according to arrow F2 in FIG. 1.
Figure 3:
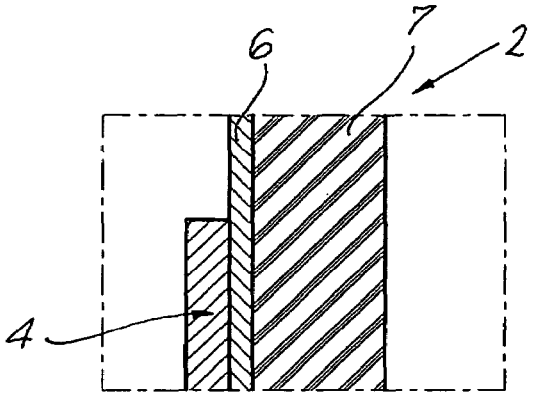
FIG. 3 represents the part indicated by F3 in FIG. 1 to a larger scale.

As is schematically represented in FIGS. 1 to 3, the improved transducer according to the invention comprises a holder 1, in this case a rectangular frame made of plastic or the like; a membrane 2 which is fixed to the holder 1 at its perimeter by means of a flexible glue 3 or the like; a piezo-electric element 4 in the shape of a piezo-ceramic disc which is fixed to the membrane 2, for example by means of gluing, whereby this piezo-electric element 4 is provided with electric conductors 5 for connecting the transducer to a signal generator which is not represented in the figures.

The invention is special in that the membrane 2 of the improved transducer is composed of two or several layers, in this case of two layers, a layer 6 made of a metal or a metal alloy and a layer 7 respectively, made of a polymer.

The layer 6 is preferably formed of a thin metal foil.

The layer 7 may comprise a foaming polymer, an expanded polymer, a molded polymer or the like, either or not filled with fibers, such as carbon fibers.

The piezo-electric element 4 is fixed to one side of the metal layer 6, whereas the layer 7 made of polymer is provided to the opposite side of this layer 6, for example by means of gluing.

The working of the improved transducer is based on the principle that when an electric signal is applied to the conductors 5, the membrane 2 will start to vibrate as a function of this signal. This causes an air displacement, as a result of which sound is generated.

By applying a membrane 2 with a layered structure, depending on the desired application, the rigidity and thickness of the membrane 2 are adjusted in order to obtain a more accurate reproduction of the applied signal.

The membrane 2 can be composed according to the invention of any combination of layers 6 made of metal and layers 7 made of polymer.

Figure 4:
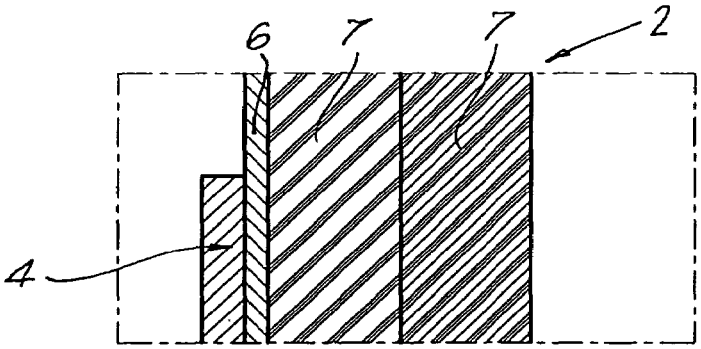
FIGS. 4 to 7 represent variants of FIG. 3.
Figure 5:
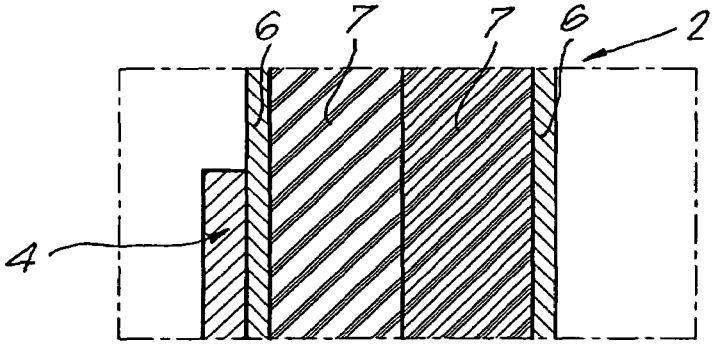
Figure 6:
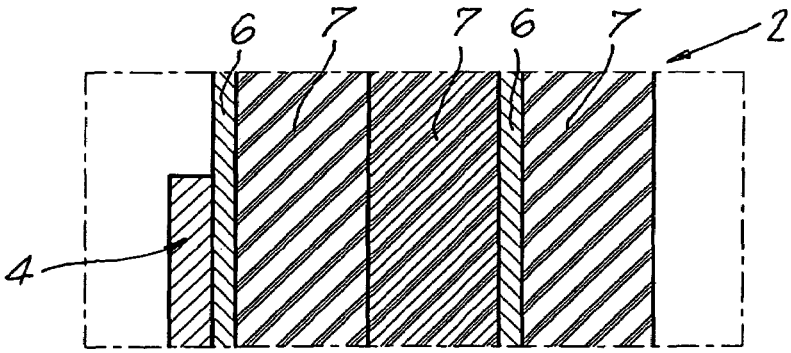

This is illustrated by way of an example by means of FIGS. 4 to 6, whereby, in these cases, the membrane 2 is respectively formed of:

- a layer 6 made of metal with two layers 7 made of polymer in the case of FIG. 4;

a membrane 2, as in FIG. 4, with an additional layer 6 made of metal on it in the case of FIG. 5;

a membrane 2, as in FIG. 5, with an additional layer 7 made of polymer on it in the case of FIG. 6.

Figure 7:
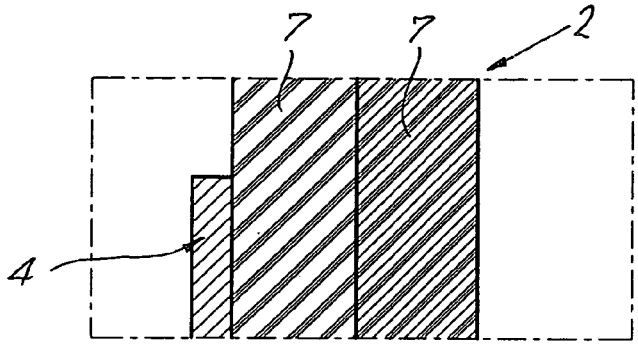

Also a combination of solely layers 7 made of polymer is possible, as is represented for example by means of FIG. 7 in which two layers 7 are applied.

It is clear that, when several layers 6 made of metal and/or several layers 7 made of polymer are applied, these layers 6-7 do not necessarily have to be made of the same metal or the same polymer.

Figure 8:
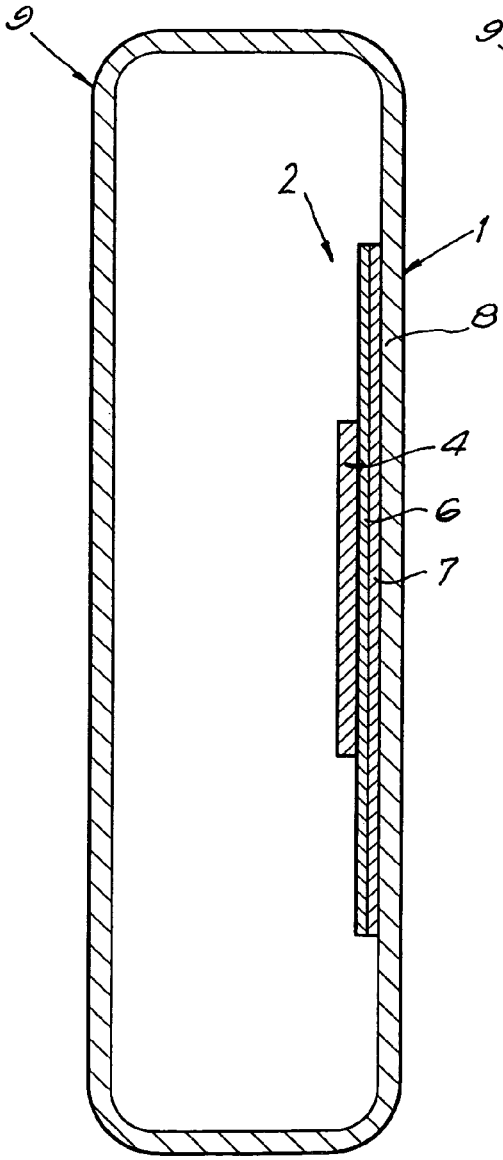
FIGS. 8 and 9 represent an improved transducer provided in a housing.

FIG. 8 represents a variant of a transducer according to the invention, whereby, in this case, the membrane 2 is not provided on a frame-shaped holder 1, but is fixed directly, by means of gluing or the like, to a wall 8, for example to a wall 8 of a housing 9 of a loudspeaker, microphone, mobile phone, hearing aid or another audio device.

When the wall 8 of a housing 9 is also formed of metal or polymer in this case, said wall 8 may serve as a layer 6 or 7 of the membrane 2 concerned, such that the transducer is in fact integrated in this wall 8 and/or the housing 9.

Figure 9:
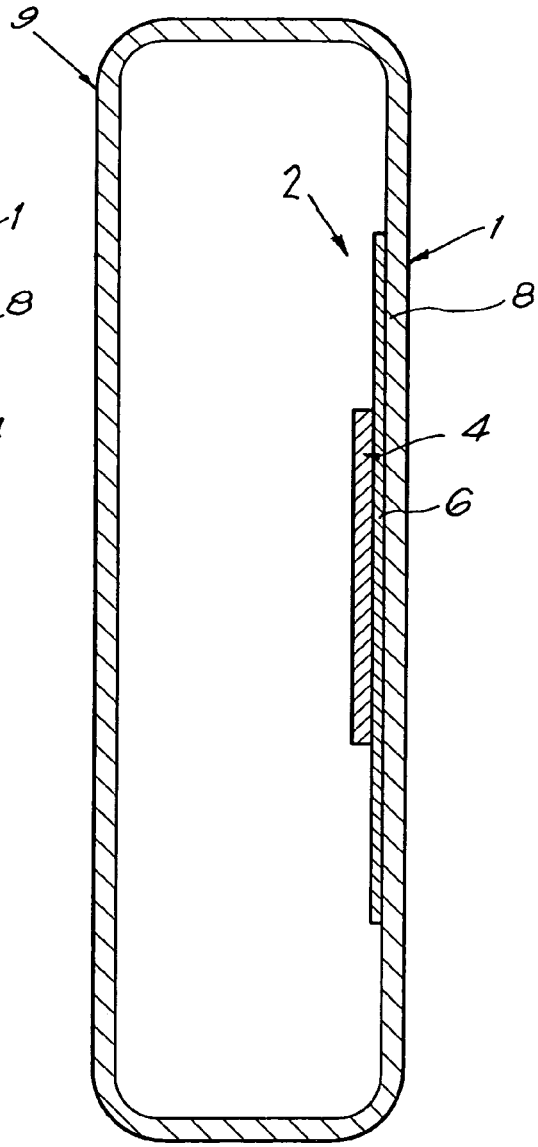
Figure 10:
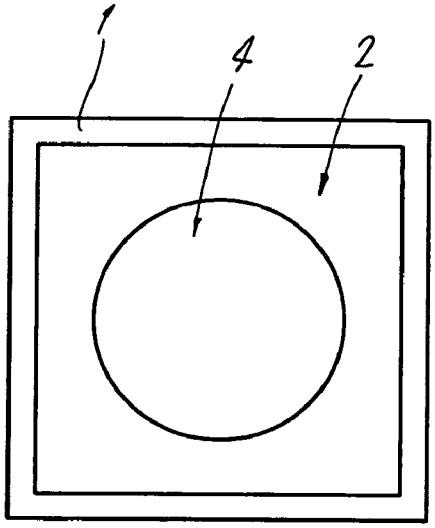
FIGS. 10 to 15 represent variants of FIG. 2, but to a smaller scale.
Figure 11:
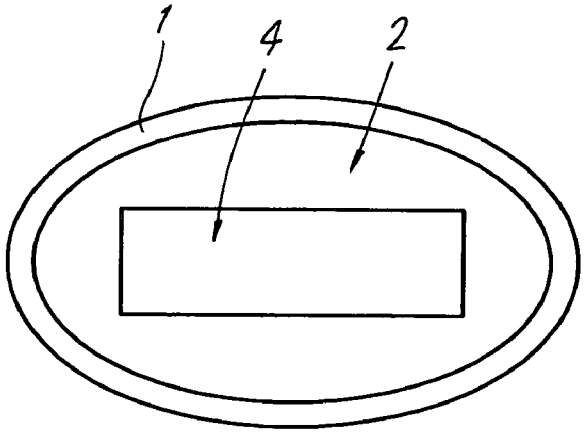
Figure 12:
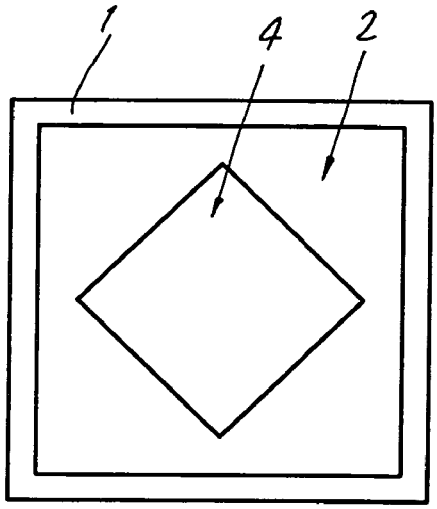

FIG. 9 represents a variant whereby the membrane 2 is integrated in a polymer housing 9 and whereby the membrane 2 is formed of a wall 8 of this housing 9 and a layer 6 made of a metal foil glued to the wall 8 and onto which the piezo-electric element 4 is fixed.

An advantage resulting from this integration of the membrane 2 in a wall 8 and/or housing 9 is that the transducer must not be provided behind a perforated wall, which no doubt offers an aesthetic advantage on the one hand and implies less losses and distortions of the emitted sound on the other hand.

In practice it was found that the best results are obtained when the shape of the piezo-electric element 4, in particular the shape of the perimeter of this piezo-electric element 4, is different from the shape of the membrane 2, and in particular when the membrane 2 is preferably not round and does not have a symmetry over 360° in relation to the shape of the piezo-electric element 4.

Figure 13:
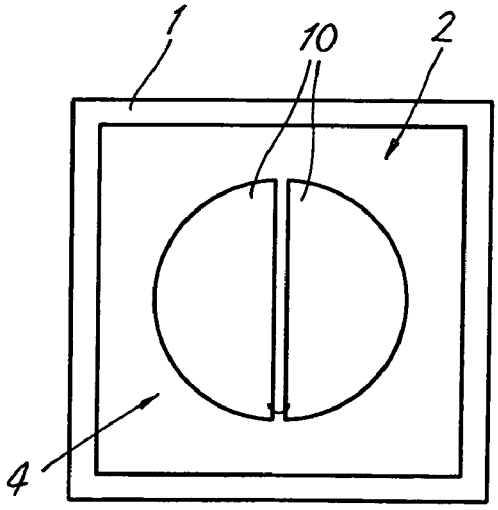
Figure 14:
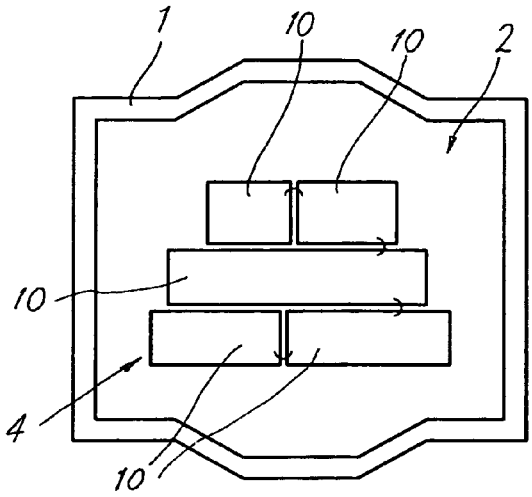
Figure 15:
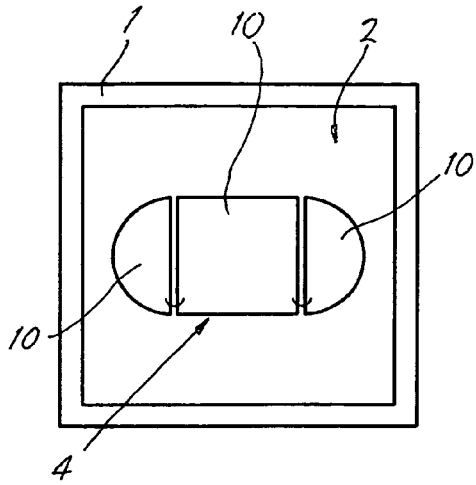

FIGS. 10 to 15 represent some possible shapes of improved transducers according to the invention, whereby, in particular in FIGS. 13 to 15, a multipart piezo-electric element 4 is represented which is formed of several, mutually connected parts 10.

The present invention can be either or not combined with the characteristics of the invention described in the aforesaid patent BE 1,013,592.

Figure 16:
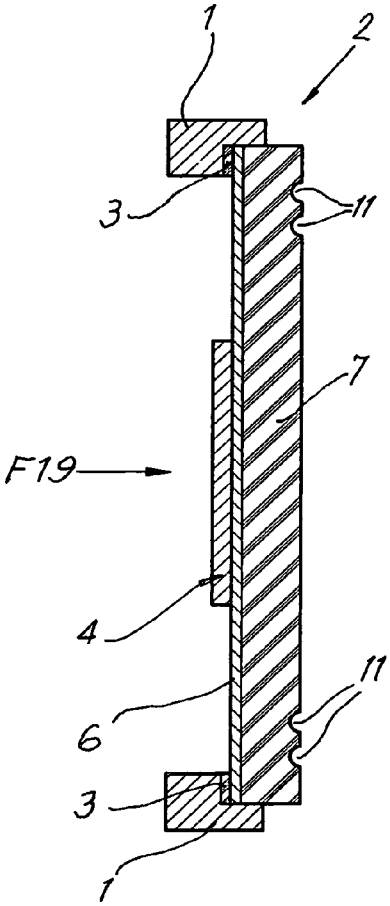
FIG. 16 represents a variant of FIG. 1.
Figure 17:
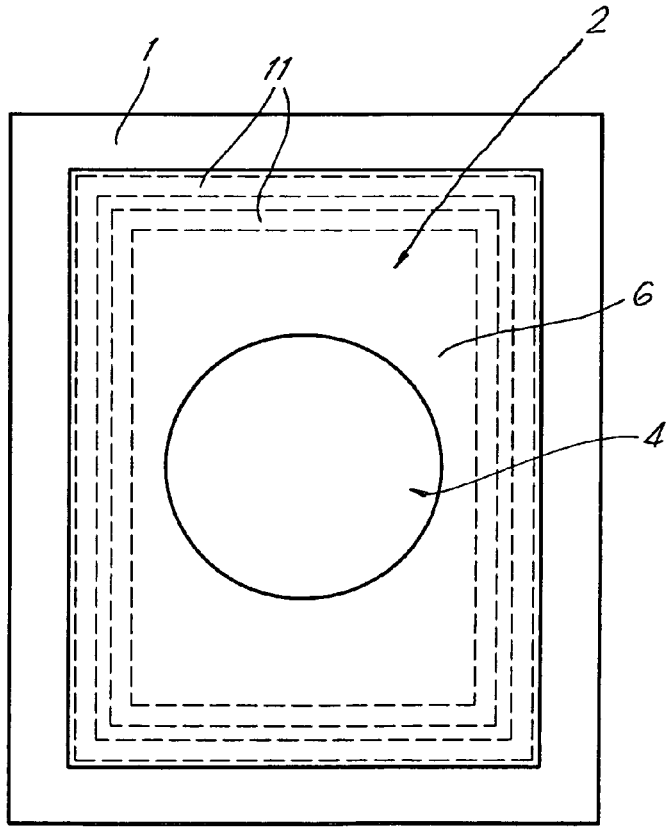
FIG. 17 represents a view according to arrow F17 in FIG. 16.

Thus, for example, as represented in FIGS. 16 and 17, the membrane 2 can be provided with one or several grooves 11 along its perimeter penetrating in one or several layers 6 and/or 7.

Figure 18:
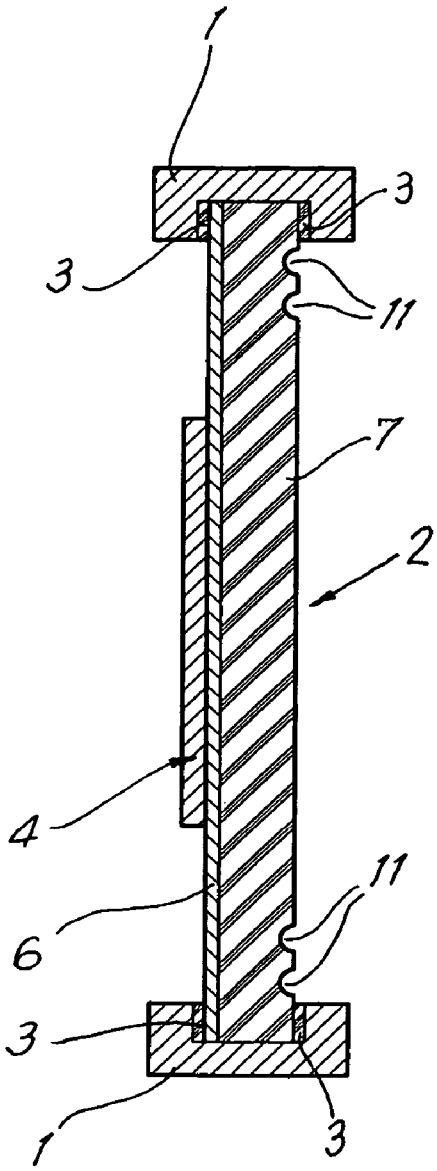
FIGS. 18 and 19 represent other embodiments of an improved transducer provided in a housing.
Figure 19:
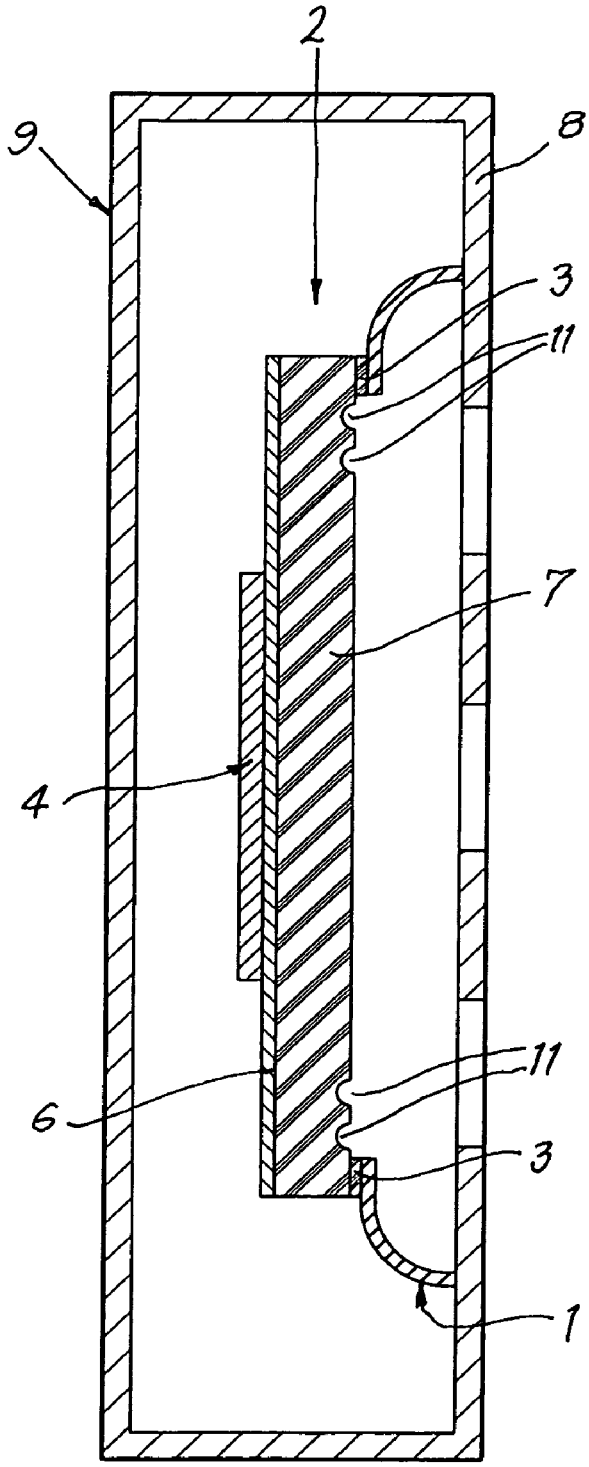

Further, it is also possible according to patent BE 1,013,592 to fix the membrane 2, as represented in FIG. 18, in a frame-shaped holder 1 with a U-shaped section or, as in the case of FIG. 19, on a frame-shaped holder 1 which is fixed to a housing 9 or which is part of it.

The invention is by no means limited to the above-described embodiments given as an example and represented in the accompanying drawings; on the contrary, such an improved transducer according to the invention can be made in all sorts of shapes and dimensions while still remaining within the scope of the invention.

The invention claimed is:

1. A piezo-electric transducer for reproducing or recording sound, comprising a membrane onto which is provided a one-piece piezo-electric element, the membrane composed of a plurality of layers of which at least one layer is made of a polymer;

wherein the piezo-electric element has two radial surfaces, an entirety of one of the radial surfaces being directly glued onto the membrane;

wherein the membrane is glued to a holder;

wherein the shape of the perimeter of the piezo-electric element differs from the shape of the perimeter of the membrane as a result of which the perimeter of the membrane lacks symmetry over 360 degrees in relation to the perimeter of the piezo-electric element; and wherein the membrane does not have a U-shaped diameter.

2. The piezo-electric transducer according to claim 1, wherein at least one layer of the membrane is made of metal.

3. The piezo-electric transducer according to claim 1, wherein at least one layer of the membrane is made of a metal alloy.

4. The piezo-electric transducer according to claim 1, wherein said layer made of polymer is filled with an anisotropic fiber structure.

5. The piezo-electric transducer according to claim 1, wherein said layer made of polymer is filled with isotropically woven synthetic fibers.

6. The piezo-electric transducer according to claim 1, wherein the aforesaid layers of the membrane are glued to each other.

7. The piezo-electric transducer according to claim 2, wherein the piezo-electric element is provided on an outer layer of the membrane, and the outer layer is made of metal.

8. The piezo-electric transducer according to claim 1, wherein at least one layer of the membrane is formed of a foaming polymer.

9. The piezo-electric transducer according to claim 1, wherein at least one layer of the membrane is formed of an expanded polymer.

10. The piezo-electric transducer according to claim 1, wherein at least one layer of the membrane is formed of a molded polymer.

11. The piezo-electric transducer according to claim 2, wherein the layer made of metal is formed of a thin foil.

12. The piezo-electric transducer according to claim 1, wherein the holder is formed of a wall of a housing device.

13. The transducer according to claim 1, wherein at least one layer of the membrane is part of a wall, in particular the wall of a housing of a device.

* * * * *